US007293754B2

(12) United States Patent
Gallien

(10) Patent No.: US 7,293,754 B2
(45) Date of Patent: Nov. 13, 2007

(54) FRAME SECURITY LOCK

(75) Inventor: James M. Gallien, Hidden Hills, CA (US)

(73) Assignee: Hangman Products, Inc., Woodland Hills, CA (US)

( * ) Notice: Subject to any disclaimer, the term of this patent is extended or adjusted under 35 U.S.C. 154(b) by 190 days.

(21) Appl. No.: 10/921,647

(22) Filed: Aug. 19, 2004

(65) Prior Publication Data

US 2006/0038105 A1 Feb. 23, 2006

(51) Int. Cl.
*A47F 7/14* (2006.01)

(52) U.S. Cl. ..... 248/475.1; 248/477; 248/221.11

(58) Field of Classification Search ..... 248/221.11, 248/222.11, 222.12, 476, 477, 475.1
See application file for complete search history.

(56) References Cited

U.S. PATENT DOCUMENTS 3,724,085 A * 4/1973 Wentworth ..... 33/562
4,018,339 A * 4/1977 Pritz ..... 211/8
4,228,982 A 10/1980 Sellera
4,283,038 A * 8/1981 Kurtz ..... 248/478
4,597,554 A 7/1986 James
4,712,761 A 12/1987 Wassell
5,303,895 A 4/1994 Hart
5,584,462 A * 12/1996 Reese ..... 248/477
5,791,625 A * 8/1998 Orser ..... 248/495
5,802,729 A 9/1998 O'Brien et al.
6,286,802 B1 9/2001 Munson
6,637,707 B1 * 10/2003 Gates et al. ..... 248/224.7
7,090,085 B1 * 8/2006 Vicendese et al. ..... 211/106.01

* cited by examiner

*Primary Examiner*—Carl D. Friedman
*Assistant Examiner*—Steven Marsh
(74) *Attorney, Agent, or Firm*—Stetina Brunda Garred & Brucker

(57) ABSTRACT

A locking mechanism for preventing theft of an object hung on a flat surface is provided. The locking mechanism may comprise a latch, hook and key. The latch may be attachable to the wall with an optional wall track attached thereto. Also, the hook may be attachable to the object with an optional object track attached thereto with the object track engageable to the wall track when the object is hung on the wall. Furthermore, the hook is engageable into the latch simultaneously as the object track engages the wall track.

5 Claims, 4 Drawing Sheets

FRAME SECURITY LOCK

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The present invention relates to a locking mechanism, and more particularly to a locking mechanism for an object hung on a wall to prevent theft of the object.

Public places such as parks, airports, hotels are frequently decorated with paintings, pictures, sculptures, and other objects. For example, in hotel rooms, the walls of the room may be decorated with a painting, or a mirror may be hung on one of the walls. In this regard, hanging systems have been invented which addresses the method by which these decorative objects may be hung on the wall. One such apparatus is further described in U.S. Pat. No. 6,286,802 ("'802 patent") which is expressly incorporated herein by reference and further discussed in the DETAILED DESCRIPTION OF THE PRESENT INVENTION section of this application. In the '802 patent, a frame is hung on a wall via a wall track attached to the wall and a frame track attached to the frame. The wall track and frame tracks interlock with each other to hang the frame on the wall. Moreover, the wall track may be an elongate member which engages the frame track along their respective lengths. As such, the frame is always aligned with the wall track and always level with the ground. This hanging system may be employed at hotels to hang pictures and paintings on walls of the hotel rooms as well as to hang mirrors in public restrooms. However, this hanging system does not have a theft deterrent device which prevents guests and visitors from removing the painting or picture hung on the wall and stealing the same.

Accordingly, there is a need in the art to provide a mechanism to prevent removal of objects (e.g., pictures and paintings) hung on walls.

BRIEF SUMMARY OF THE INVENTION

In accordance with the present invention, there is provided a locking mechanism which may include a hook, latch and key. This locking mechanism may be used in conjunction with a hanging system, or in the alternative, may be employed by itself.

The hook may define a base portion which is attachable to a frame via a screw, an extension portion and a flange portion. When the hook is attached to the frame, a vertical center line of the hook may be aligned to a horizontal center line of the frame, and a distal tip of the flange portion may be flush with a lower edge of the frame. Furthermore, the hook may have two prongs with a J-shaped configuration comprising the extension portion and the flange portion. Interposed between the two prongs may be a gap which may be sized and configured to receive the key.

The latch may have a C-shaped configuration with distal ends thereof attached to bases. The bases may have an aperture to permit attachment of the latch to the wall via an attachment device (e.g., screw). The latch may further define a middle portion which may have a hook engagement portion attached thereto. The hook engagement portion may further define an open position and a closed position.

In use, the latch may be attached to the wall, and the hook may be attached to the frame. In this regard, the hook may be inserted into a first opening and extended through a second opening of the latch to place the locking mechanism in an engaged position. To remove the frame from the wall in the engaged position, the key may be inserted in the gap to lift the hook engagement portion of the latch to the open position. In this open position, the flange portion of the hook may freely pass under the hook engagement portion and middle portion of the latch to release the frame from the wall.

In another aspect of the present invention, the locking mechanism may be used in conjunction with a hanging system. In this regard, the hanging system may comprise a wall track which is attached to the wall, and a frame track which is attached to the frame. In this regard, to hang the frame on the wall, the frame track is engaged to the wall track. Also, as the frame track engages the wall track, the flange portion of the hook may be simultaneously inserted into the first opening of the latch and under the hook engagement portion to thereby traverse the hook engagement portion to the open position. The hook, and more particularly, the flange portion may further extend past the second opening of the latch. At this point, the hook engagement portion may be in a closed position to place the locking mechanism in the engaged position. Accordingly, the frame may not be removed from the wall without the key.

The key may have a grasping portion where a user may grasp the key, a landing portion defining a landing surface and a distal tip with a beveled surface. In this regard, the distal tip of the key may be inserted under the hook engagement portion between the gap from a bottom side of the frame. As the distal tip is inserted under the hook engagement portion, the beveled surface raises the hook engagement portion to the open position until a distal tip of the hook engagement portion rests upon the landing surface. Since the landing surface may be parallel with a bottom surface of the key, the user may release the grasping portion and remove the frame from the wall.

In another aspect of the present invention, a method of installing a locking mechanism to an object to be hung on a flat surface is provided. The method may comprise the optional step of installing the hanging system on the wall (i.e., flat surface) and frame (i.e., object). The method may further comprise the steps of installing a latch on the flat surface and installing a hook on the object. In this regard, the installing the latch step may comprise the steps of inscribing a scribe line along a lower edge of the object when the object is hung on the flat surface, aligning a lower edge of a template with the scribe line wherein the template has an aperture, marking the location of the aperture on the flat surface, aligning a latch aperture with the marked location, securing the latch to the flat surface via an attachment device.

The installing the hook step may comprise the steps of aligning a vertical centerline of the hook with a vertical centerline of the object, aligning a distal tip of the flange portion with the lower edge of the object and securing the hook to the object with an attachment device.

BRIEF DESCRIPTION OF THE DRAWINGS

An illustrative and presently preferred embodiment of the invention is shown in the accompanying drawings in which.

DETAILED DESCRIPTION OF THE INVENTION

Figure 1:
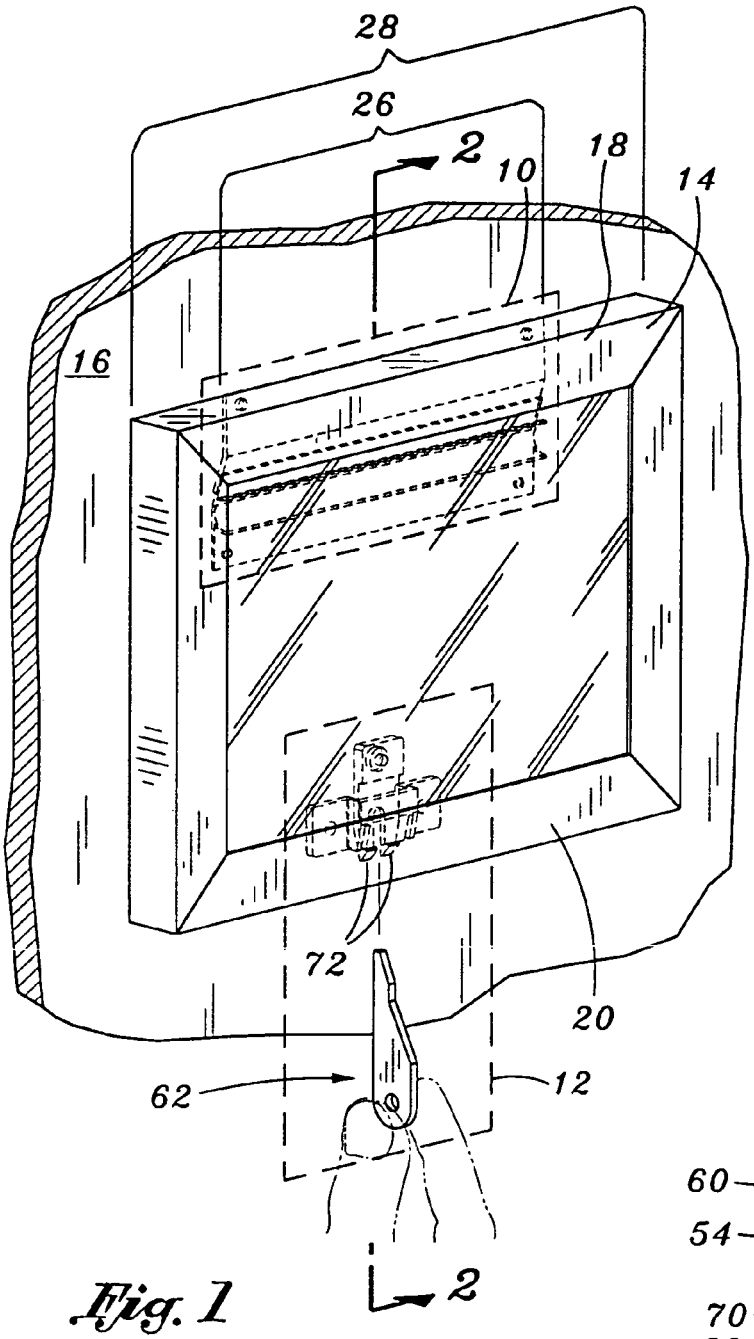
FIG. 1 is a perspective view of a hanging system and locking mechanism installed on a wall and picture frame wherein the picture frame is removeable from the wall with a key.

Referring now to the drawings which are presented for the purpose of illustrating the preferred embodiments of the present invention and not to limit any aspects of the present invention disclosed herein, FIG. 1 illustrates a hanging system 10 together with a locking mechanism 12 which may be attached to a picture frame, mirror or any type of object 14 to be hung on a wall 16 or other object to prevent removal of the object 14 from the wall 16 once attached. For example, paintings are frequently hung on walls of hotel rooms. In this regard, guests may steal the painting by removing the painting along with its frame 14. Accordingly, employment of the locking mechanism 12 prevents guests from taking the painting down from the wall 16 and possible stealing the painting 14. Although FIG. 1 illustrates the locking mechanism 12 in conjunction with the hanging system 10, the various aspects of the present invention disclosed herein may be employed with only the locking mechanism 12. For example, the object 14 shown in FIG. 1 may be hung on the wall with the locking mechanism 12 attached near the top side 18 instead of near the bottom side 20 of the object 14.

Figure 2:
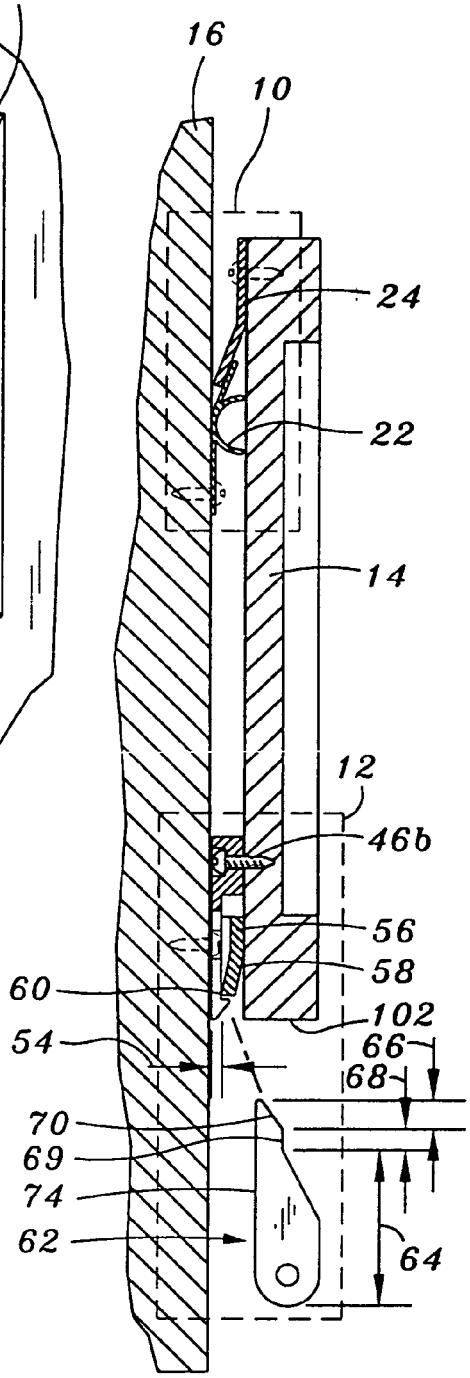
FIG. 2 is a cross-sectional side view of FIG. 1 with a hook engagement portion of the latch in a closed position.
Figure 3:
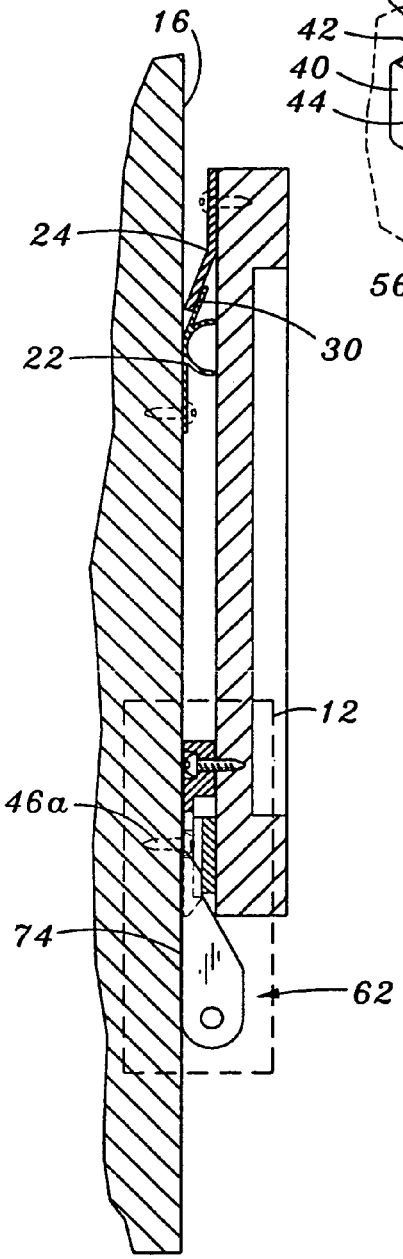
FIG. 3 is a cross-sectional side view of FIG. 1 illustrating the hook engagement portion in an open position with the key slid under the hook engagement portion and a distal tip of the hook engagement portion resting on a landing surface of the key.
Figure 4:
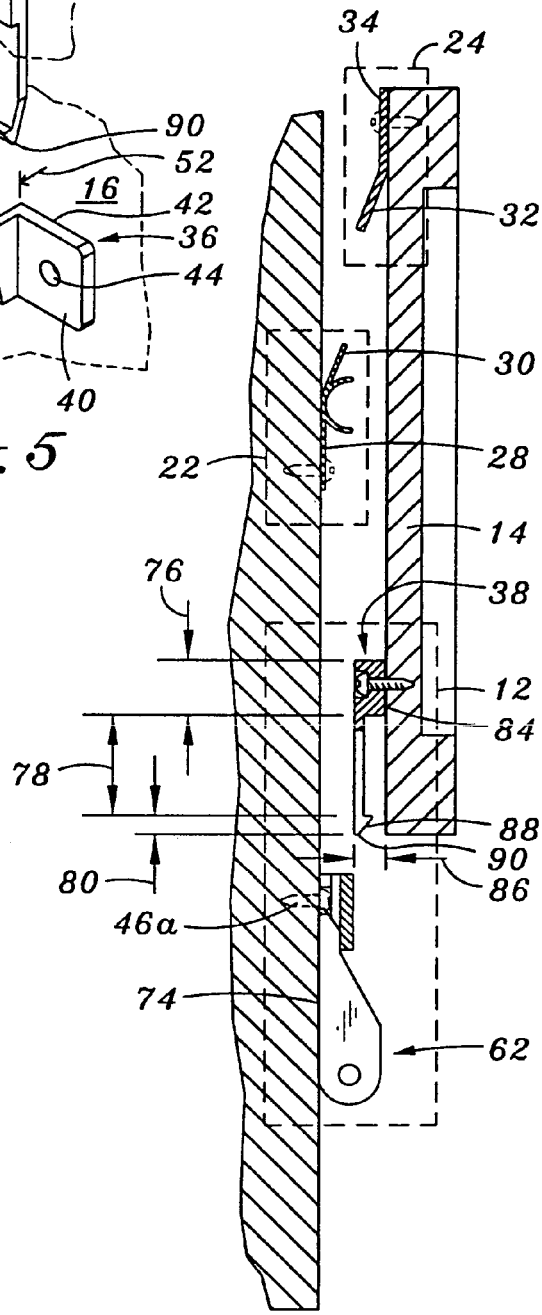
FIG. 4 is a cross-sectional side view of FIG. 1 with a hook disengaged from the latch and the frame removed from the wall.

FIG. 2 which is a cross sectional side view of FIG. 1 shows that the hanging system 10 may be employed to hang the object 14 on the wall 16. The specifics of which are more fully described in U.S. Pat. No. 6,286,802 which is briefly described below. The hanging system 10 may comprise a wall track 22 and object track 24 which may be longitudinally sizeable (see FIG. 1) to any width 26 to fit an object width 28. Referring now to FIGS. 3 and 4, the wall track 22 may be angled or bent to thereby define lower and upper attachment portions 28, 30 (see FIG. 4). Similarly, the object track 24 may be angled or bent to thereby define lower and upper attachment portions 32, 34 (see FIG. 4). In use, the wall track 24 may be attached to the wall in a leveled manner (i.e., horizontally), and the object track 24 may be attached to the object 14 such that the object is level once it is hung on the wall. Thereafter, the object track lower attachment portion 32 may be slide between the wall 16 and wall track upper attachment portion 30 (see FIG. 3) to hang the object 14 on the wall 16.

Figure 5:
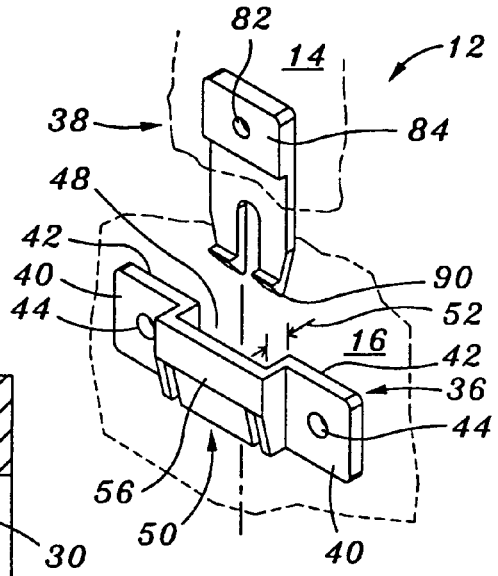
FIG. 5 is a perspective section view of the latch and hook in a disengaged position.

In FIGS. 1 and 2, the locking mechanism 12 is shown in an engaged position, and FIGS. 4 and 5 illustrate the locking mechanism 12 in a disengaged position. As best shown in FIG. 5, the locking mechanism may have a latch 36 and a hook 38. The latch 36 may have a C-shaped configuration. Distal ends of the latch may be attached to bases 40 with contact surfaces 42 of the bases in co-planar alignment. Each base 40 may further have a circular hole (i.e., aperture) 44 for attachment of the latch 36 to the wall 16 via a screw **46*a* (see FIGS. 3 and 4) therethrough. It is also contemplated within the scope of the present invention that the aperture 44 may be an elongate hole formed longitudinally to allow for adjustment of the latch 36 when being attached to the wall 16**.

As shown in FIG. 5, the latch 36 and the contact surfaces 40 (i.e., essentially the wall) of the bases may define a first opening 48 and a second opening 50. The first opening 48 may define a first opening height 52, and the second opening 50 may define a second opening height 54 (see FIG. 2) which is smaller compared to first opening height 52. In particular, the first opening height 52 is defined by a latch middle portion 56 and the contact surfaces 42 (see FIG. 5), whereas the second opening height 54 is defined by a hook engagement portion 58 (see FIG. 2) and the contact surfaces 42. More particularly, the middle portion 56 may be attached to the hook engagement portion 58 and a distal tip 60 of the hook engagement portion 58 may define the second opening height 54. The hook engagement portion 58 may be bent or angled toward the wall 16 and traverseable between open and closed positions. The open position is shown in FIGS. 3 and 4, and the closed position is shown in FIGS. 1, 2 and 5. More particularly, the hook engagement portion 58 may be traversed between the open and closed positions via flexure of the hook engagement portion 58 itself and/or flexure at the attachment between the hook engagement portion 58 and the middle portion 56.

The hook engagement portion 58 may be traversed between the open and closed positions with a key 62 which is illustrated in FIGS. 1-4. More particularly, as shown in FIG. 2, the key 62 may define a grasping portion 64 which is sized and configured to be grasped by a person's hand. The key 62 may additionally define a distal tip 66 and a landing portion 68 which further defines a landing surface 69. The key distal tip 66 may have a beveled surface 70 which initially contacts the hook engagement portion distal tip 60 as the key 62 is inserted into the latch second opening 50. As more clearly shown in FIG. 1, the distal tip 60 and landing portion 68 of the key 62 slide between two J-shaped prongs 72 of the hook 38. As the key 62 is further inserted into the latch second opening 50, the beveled surface 70 pushes the hook engagement portion 58 away from the wall 16 to the open position. This traversal of the hook engagement portion 58 from the closed position to the open position is shown in comparing the hook engagement portion 58 shown in FIGS. 2 and 3. When the key 62 is fully inserted under the hook engagement portion 58, the same 58 may rest on the landing surface 69 which is parallel to a bottom surface 74 (see FIGS. 3 and 4) of the key, as shown in FIG. 3. At this point, the user may release the grasping portion 64 and disengage the locking mechanism 12, as shown in FIG. 4.

As shown in FIGS. 1-5, the hook 38 is engageable with the latch 36 (i.e., the hook 38 may be engaged to or disengaged from the latch 36). In particular, referring now to FIG. 4, the hook 38 may comprise the J-shaped prong discussed above wherein each prong 72 may define a base portion 76, extension portion 78 and flange portion 80. The base portion 76 as shown in FIG. 5 may have a circular aperture 82 formed therethrough for attachment of the hook 38 to the object 14 with a screw 46*b* (see FIG. 2). Although a circular aperture 82 is shown, the aperture 82 may have an elongate configuration along a horizontal direction of the hook 38 to allow for adjustment of the hook 38 when being attached to the object 14. The flange portion 80 of the hook 38 may be attached to the base portion 76 via the extension portion 78. The hook 38 when attached to the object 14 may be oriented with the flange portion 80 directed toward the object 14, as shown in FIG. 4. Moreover, the flange portion 80 and a contact surface 84 (see FIGS. 4 and 5) of the key base portion 76 may define a flange portion height 86. More particularly, the flange portion 80 may have a beveled surface 88 defining a distal tip 90, and the flange portion distal tip 90 and the contact surface 84 (see FIG. 4) may define the flange portion height 86. Furthermore, the hook 38 may have one or two J-shaped prongs 72.

In use, to hang the object 14 on the wall 16, optionally, the wall track 22 and the object track 24 may be attached to the wall 16 and object 14, respectively. Thereafter, the hook flange portion 80, which may be sized and configured to be received into the latch first opening 48, may be inserted into the latch first opening 48, and simultaneously, the wall track 22 and object track 24 may be engaged to each other. Moreover, as the wall track 22 and the object track 24 are being engaged to each other, the hook flange portion 80, and more particularly, its beveled surface 88 may engage the hook engagement portion 58 and push such portion 58 to its open position (i.e., upward and away from the wall 16) to allow the flange portion 80 to traverse thereunder. Moreover, when the wall and object tracks 22, 24 are fully engaged (i.e., the object 14 is hung on the wall 16), the hook flange portion 80 may have traversed past the hook engagement portion 58 to engage the hook 38 to the latch 36 (see FIG. 2). At this point, the hook engagement portion 58 may have deflected back to its closed position and securely fixed the object 14 to the wall 16. At this point, the object 14 may not be removed without the key 62.

To remove the object 14 from the wall, the key 62 may be inserted adjacent the hook flange portion(s) 80, and more preferably, between the two J-shaped prongs 72 (see FIG. 1). In particular, the key distal tip 66 may be inserted into the latch second opening 50. The beveled surface 70 of the key distal tip 66 may push the hook engagement portion 58 from its closed position to its open position. The hook engagement portion 58 when pushed into the open position by the key 62 may rest on the landing surface 69 such that the user may remove their fingers holding the key grasping portion 64 to slide the flange portion 80 under the hook engagement portion 58 and disengage the locking mechanism 12, as shown in comparing FIGS. 3 and 4.

Figure 6:
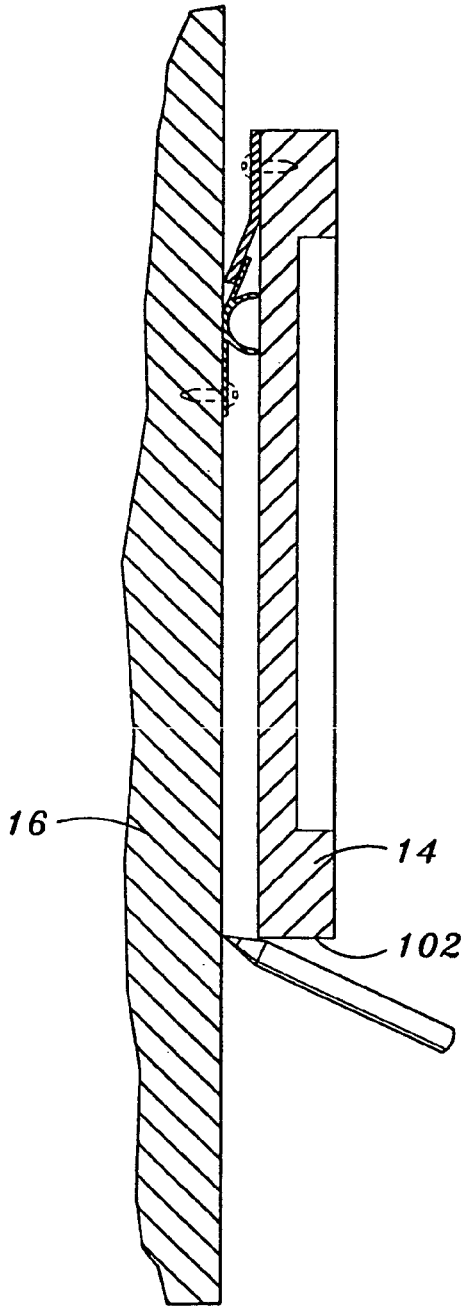
FIG. 6 is cross-sectional side view of a hanging system installed on a picture frame and a wall with a scribe line being inscribed on the wall along a lower edge of the picture frame.
Figure 8:
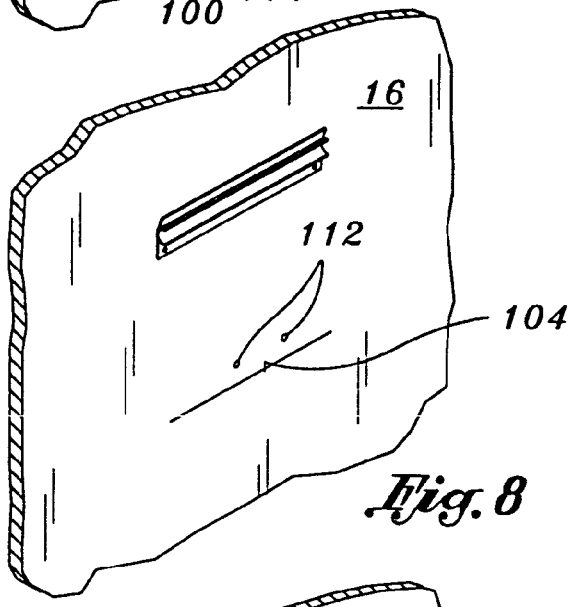
FIG. 8 is a perspective view of the wall of FIG. 6 with markings showing locations of a template aperture shown in FIG. 7.
Figure 9:
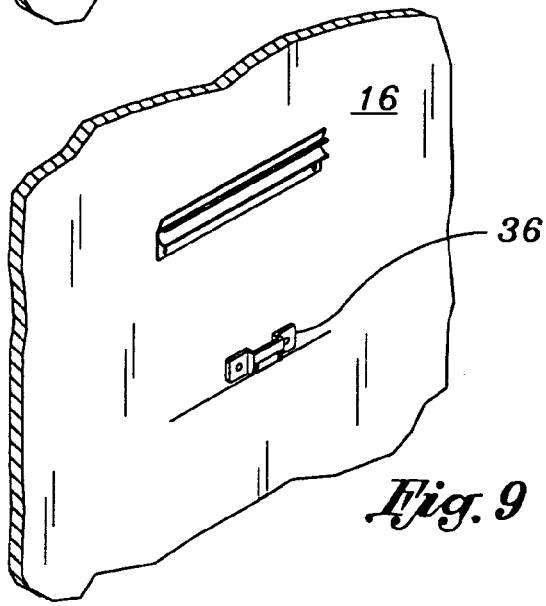
FIG. 9 is a perspective view of the wall of FIG. 6 showing the latch with its apertures aligned to the marking shown in FIG. 8.

In another aspect of the present invention, a method of installing a locking mechanism 12 to an object 14 and surface 16 wherein the object 14 may be hung on the surface 16 is provided. This method is illustratively shown in FIGS. 6-11. The method may comprise the steps of (1) optionally, installing a hanging system 10 on the object 14 and surface 16 such that the object 14 is hangable on the surface 16 (see FIG. 6), (2) installing a latch 36 on the surface 16 (see FIGS. 6-9), and (3) installing a hook 38 on the object 14 (see FIGS. 10-11). More particularly, in relation to installing a latch step, the same may further comprise the steps of (1) hanging the object 14 on the surface 16 (see FIG. 6), (2) inscribing a scribe line 100 along a lower edge 102 of the object 14 (see FIGS. 6 and 7), (3) aligning a lower edge 108 of a template 106 with the scribe line 100 (see FIG. 7), (4) marking a location(s) of a template aperture(s) 114 on the surface 16 (see FIG. 8), and (5) attaching the latch 36 to the surface 16 with respect to the marked location 112 of the template aperture 114 (see FIG. 9). The template aperture(s) 114 may indicate the location(s) of the base aperture(s) 44 of the latch 36.

Figure 7:
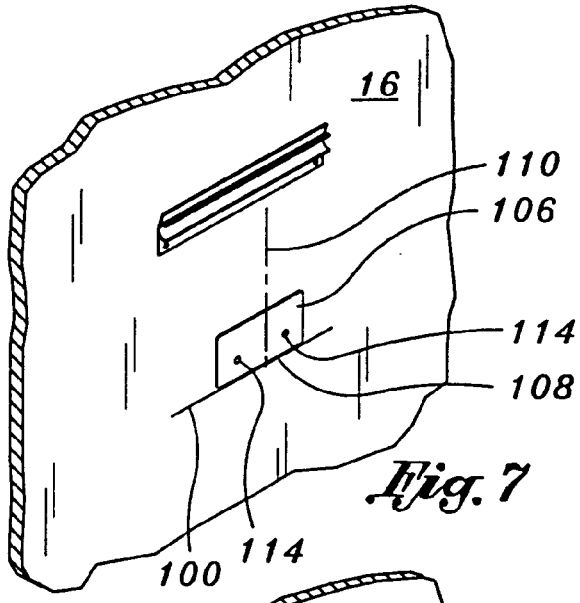
FIG. 7 is a perspective view of a template with its lower edge aligned with the scribe line of FIG. 6.

Furthermore, in conjunction with the inscribing a scribe line step and the aligning a lower edge step, the method may further comprise the step of inscribing a midpoint line 104 on the surface 16 which represents a centerline 118 of the object 14 (see FIG. 11) and aligning a centerline of the template 110 with the midpoint line 104 (see FIG. 7).

Figure 10:
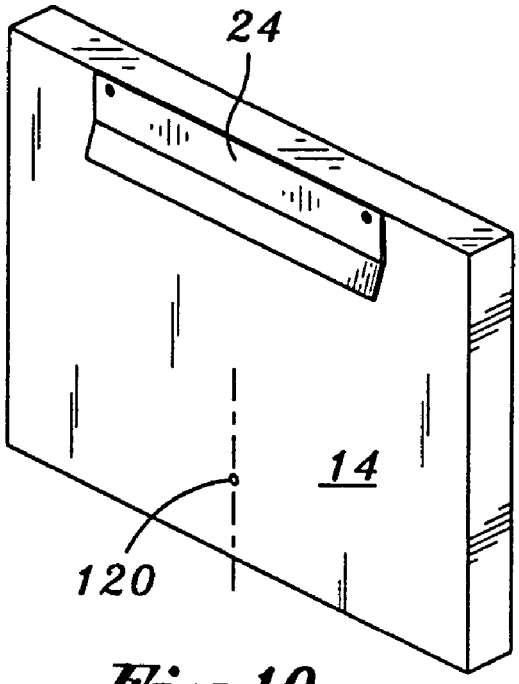
FIG. 10 is a perspective view of the picture frame of FIG. 6 illustrating an attachment point for the hook wherein a center line of the hook is aligned with a center line of the object and a hook flange portion distal tip is aligned with the lower edge of the picture frame when the hook aperture is aligned to the attachment point.
Figure 11:
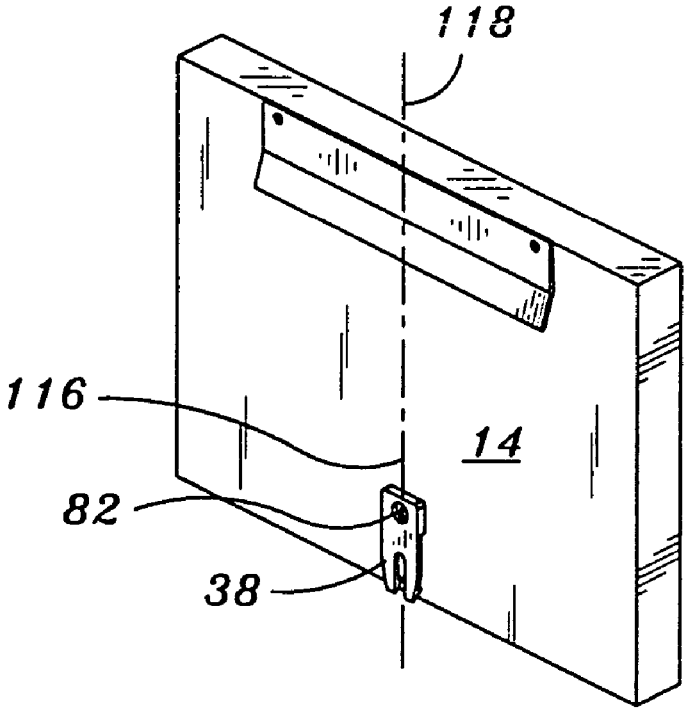
FIG. 11 is a perspective view of the picture frame and hook with the hook center line aligned to the object center line and the hook flange portion distal tip aligned with the lower edge of the picture frame.

Additionally, more particularly in relation to the installing a hook step (see FIGS. 10 and 11), the same may further comprise the step of locating an attachment point 120 (e.g., pencil marking or drilled hole) for the hook 38 on the object 14 (see FIG. 10). In this regard, a hook centerline 116 may be aligned with the object centerline 118 (see FIG. 11), and a distal tip 90 of the hook flange portion 80 may be aligned with the lower edge 102 of the object 14 (see FIG. 2). This unique alignment provides for hiding the locking mechanism 12 from view. Thereafter, the attachment point 120 for the hook 38 may be located on the object 14 by marking the location of the hook aperture 82 (see FIG. 10).

This description of the various embodiments of the present invention is presented to illustrate the preferred embodiments of the present invention, and other inventive concepts may be otherwise variously embodied and employed. For example, the latch 36 may be attached to the object 14, and the hook 38 may be attached to the wall or flat surface 16. The appended claims are intended to be construed to include such variations except insofar as limited by the prior art.

What is claimed is:

1. A locking mechanism for an object removeably attachable to a wall, the mechanism comprising:

a latch attachable to the wall, the latch having a C-shaped configuration and defining a middle portion, distal ends and a hook engagement portion, the middle portion being interposed between the distal ends and the hook engagement portion being attached to the middle portion and traversable between open and closed positions; and a hook attachable to the object, the hook having a J-shaped configuration and defining a flange portion insertable between the wall and hook engagement portion when the latch is attached to the wall to thereby traverse the hook engagement portion between open and closed positions;

wherein the hook defines at least one J-shaped prong, and the mechanism further comprises a key insertable between the at least one J-shaped prong and the hook engagement portion and the wall when the latch is attached to the wall and the hook and latch are in an engaged position to traverse the hook engagement portion from the closed position to the open position to remove the object from the wall.

2. The mechanism of claim 1 wherein the key has stair step configuration.

3. The mechanism of claim 2 wherein the stair step configuration of the key is defined by a beveled surface and a landing surface.

4. The mechanism of claim 1 wherein the hook comprises a beveled surface.

5. The mechanism of claim 1 wherein the hook defines two J shaped prongs.

* * * * *